United States Patent [19]

Ksendzyk et al.

[11] 4,305,451

[45] * Dec. 15, 1981

[54] ELECTROSLAG REMELTING AND SURFACING APPARATUS

[76] Inventors: Georgy V. Ksendzyk, bulvar Lesi Ukrainki, 2, kv. 18; Isidor I. Frumin, ulitsa Bolshaya Zhitomirskaya 17, kv. 6; Vladimir S. Shirin, ulitsa Anri Barbjusa, 22/26, kv. 106, all of Kiev, U.S.S.R.

[ * ] Notice: The portion of the term of this patent subsequent to Jun. 23, 1994, has been disclaimed.

[21] Appl. No.: 72,030

[22] Filed: Sep. 4, 1979

Related U.S. Application Data

[63] Continuation of Ser. No. 809,311, Jun. 23, 1977, Pat. No. 4,185,682.

[51] Int. Cl.[3] ..... B22D 27/02

[52] U.S. Cl. ..... 164/515

[58] Field of Search ..... 164/50, 52, 250, 252; 75/10 C; 13/9 ES

[56] References Cited

U.S. PATENT DOCUMENTS 3,768,543 10/1973 Kolisnyk ..... 164/252

FOREIGN PATENT DOCUMENTS 1335383 10/1973 United Kingdom ..... 164/252

*Primary Examiner*—Robert D. Baldwin
*Assistant Examiner*—K. Y. Lin
*Attorney, Agent, or Firm*—Lilling & Greenspan

[57] ABSTRACT

An electroslag remelting and surfacing apparatus having a cooled mould comprising a plurality of superimposed sleeves which are electrically insulated from one another. The top sleeve of the mould, being substantially a non-consumable electrode, has a current lead and a lining of electrically conducting material. If provided with a radial electrically insulating layer, it may also serve as a single-coil inductor adapted to impart a rotary motion to the slag pool.

4 Claims, 11 Drawing Figures

ELECTROSLAG REMELTING AND SURFACING APPARATUS

This is a continuation, of application Ser. No. 809,311, filed June 23, 1977 now U.S. Pat. No. 4,185,682.

BACKGROUND OF THE INVENTION

The present invention relates to electrometallurgical and welding processes, and more specifically, to electroslag remelting and surfacing apparatus.

The invention may be used for producing ingots of ferrous and non-ferrous metals, in particular, of high-alloy steels and alloys, as well as for surfacing flat and cylindrical articles of various configuration.

The invention is particularly applicable for the production of bimetallic parts, by applying electroslag surfacing technique on elements or parts, such as shafts, rolls, rods, etc., wherein said parts have a relatively small diameter and considerable length, and the deposited layer composition provided on the surface thereof is different from that of the base metal. The invention may be used also in reclamation surfacing of various elements or parts, where the deposited layer properties are similar to those of the base metal. In particular, the proposed apparatus may be used for reclamation and for providing wear-resistant surfacing of rolls, such as those employed in rolling mills.

DESCRIPTION OF THE PRIOR ART

In prior-art electroslag remelting and surfacing apparatus, the welding current passes from the electrode through the liquid slag to the base plate.

Filler material is fed either in the form of a consumable electrode or it is disconnected from the lead, and the current in the latter case is supplied through a non-consumable electrode.

Apparatus with a consumable electrode are characterized by a fixed relationship between individual parameters of the process, in particular, between the intensity of the welding current, specific heat input and the melting rate. This entails undesirable interdependence between the quality of the ingot being produced and the deposited layer, and the efficiency of the process, thereby creating control difficulties.

The elimination of the above-mentioned and other fixed relationships, and more generally, the problem of process control is one of the paramount problems in electroslag metallurgy which is widely used in the production of ingots and in electroslag surfacing operations where a coating of metal having a complex composition and strictly defined properties is applied on a base metal. One of the decisive factors of the process is also the stage of preparation of a filler material.

The separation of the functions of current supply and source material feeding in apparatus with non-consumable electrode has made it possible, on the one hand, to simplify the process of fillter material preparation and, on the other hand, to break the fixed relationship between the electroslag process parameters, thus permitting more flexible control of the apparatus and process. In particular, it has enabled the use of loose fillers as source material for the electroslag process, such as powder, grains, chips and pieces of irregular shaped metal which do not require much labor for their preparation and, at the same time, it has enabled one to control the metal pool composition within the widest possible limits.

Among the advantages inherent in the of apparatus of the foregoing type is the possibility of supplying current and feed filler material at different times, which helps in eliminating flaws in the product structure caused by insufficient heating of metal at the start of the process or after accidental interruptions of current supply.

However, separation of the functions of current supply and the feeding of source material has complicated the apparatus construction which manifested itself both in the addition of new units (e.g., shielding and cooling devices for non-consumable electrodes) and in the design changes of the existing ones. This resulted in a relatively narrow sphere of their application and stipulated parallel development and improvement of simpler apparatus with consumable electrodes.

Improvements in apparatus with consumable electrodes generally have been in re-designing the mould thereof, e.g., which is to be made up of a plurality of sleeves superimposed one upon another in the process of melting, thereby making possible the production of an ingot or a deposited layer with an improved surface (see B. E. Lopayev, A. S. Pershin, V. V. Ralashnikov and V. A. Bellomyltsev "Sostavnoi Krystallizator dlia elektroshlakovogo pereplava" "Stal", No 6,1974, p.588). Such mould may comprise sleeves of variable size, permitting the production of ingots of variable cross-section, as disclosed in British Pat. No. 1,407,469.

With all constructional changes introduced in apparatus with either a consumable or a non-consumable electrode, current invariably passes to the base plate from the electrode disposed substantially in the center of the reaction space defined by the mould. Due to the fact that the metal directly under the electrode is heated to a greater depth than near the mould walls, the solidified front shape is V-shaped. Moreover, crystals are growing inclined towards the center, and along the axis of the ingot or there is a reduced strength area formed in the center of the deposited layer.

Other flaws or defects caused by non-uniform heating of the pool are possible in the structure of the remelted or deposited metal. In addition, such non-uniformity of heating causes microarcing on the interface between the molten slag and the internal surface of the mould, thereby conditioning an increased and non-uniform wear of the mould wall body.

The foregoing phenomena are obviated by mixing the liquid slag, for which purpose the mould is provided with an inductor mounted in a concentric relationship therewith, as disclosed in British Pat. No. 1,335,383.

However, the inductor with an independent cooling system mounted outside the mould, blocks the access thereto and complicates the apparatus construction as a whole.

In addition, it is difficult to achieve a stable flattening out of the solidified front shape only by means of rotation of the slag pool, since said effect depends to a considerable extent on the rotation speed which is determined by the intensity of current and other factors which are beyond exact calculation, such as physical and chemical properties of the slag and the friction force of the latter against the mould wall body.

SUMMARY OF THE INVENTION

The primary object of the present invention is to provide an electroslag remelting and surfacing apparatus which will ensure reliable production of ingots having an improved structure or articles featuring improved structure at the deposited metal.

Another object of the present invention is to provide an electroslag remelting and surfacing apparatus which by simple constructional means provides for feeding of source material in any form, including loose materials (powder, granules, shavings, pieces of irregularly shaped metal).

Yet another object of the invention is to provide an electroslag remelting and surfacing apparatus which, while featuring constructional simplicity, ensures an adaptable control of the process for the production of articles having any predetermined properties.

In particular, the object of the invention is to provide an electroslag remelting and surfacing apparatus, wherein the slag pool is free, and metal is heated by passing welding current along the periphery of the pool.

A further object of the present invention is to provide an electroslag remelting and surfacing apparatus of a simple construction, wherein current supply and heating of metal are uniform.

Yet another object of the invention is to provide a mould construction which makes it possible to use said mould as a nonconsumable electrode in the electroslag remelting and surfacing apparatus.

In addition, it is likewise an object of the invention to provide an electroslag remelting and surfacing apparatus construction permitting a stable unidirectional rotary motion of the slag pool.

Still another object of the invention is to provide an electroslag remelting and surfacing apparatus, wherein the operating rate of the electroslag process is enhanced by simple constructional means.

These and other objects of the invention are attained in on electroslag remelting and surfacing apparatus comprising a power source with current leads, a base plate connected through one of said current leads to the power source to function as a first non-consumable electrode in the electroslag process, a mould having an annular wall body forming an opened-end cavity, and said wall body being mounted on the base plate and divided into superimposed sleeves made in the form of hollow members. Also, a mechanism for feeding a filler is mounted above the mould. According to the invention, the sleeves of the mould are electrically insulated from one another, and one of said sleeves, in particular a top one, is connected through another current lead to the power source and functions as a second non-consumable electrode in the electroslag process.

The current-leading top sleeve of the mould should preferably contain a lining made of electrically conducting material to protect the mould from spark erosion.

A clamp of the filler feed mechanism may be connected to the power source in parallel with the top sleeve of the mould so that filler material may function as a consumable electrode.

It is expedient that the electroslag remelting and surfacing apparatus includes a means for creating an electromagnetic force field which causes a unidirectional (horizontal plane or vertical plane) stable rotary motion of the molten slag pool. The current supply sleeve of the mould may be used as such means, provided it has a substantially vertically extending open slot filled with electrically insulating material, in which case the rotary motion of the slag pool is a horizontal plane. Rotation of the slag pool in a vertical plane may be provided by means of a horizontally extending slot and unilateral current supply in a current-supply mould.

It should also be appreciated that the rotary motion of the slag pool inherently results also in a rotary motion of the molten metal pool, and as rotary motion of the metal pool is dependent on the slag pool rotary motion, the speed of this rotation is less than the slag pool rotational speed.

The advantage of the present invention over prior art equipment consists first of all in that the passage of welding current from the top sleeve of the mould to the base plate along the periphery of the slag pool creates favorable conditions for the solidification of molten metal, since when heating of metal is directed from the periphery towards the center, the solidified front has an almost flat or convex shape to result in a parallel or fan-shaped growth of crystals, thereby precluding the formation of defective flaws in the center of the ingot or deposited layer.

The apparatus according to the invention provides for effective utilization of the entire slag pool area. In particular, as a result of combining the functions of the current lead and mould in one unit, the space over the pool became free, enabling the feeding of filler material to any point in the pool by positioning in a suitable manner a device for charging said material, including loose material feeders, the application of which, as mentioned above, provides maximum simplification of the production process and accurate control of physical properties of the ingot or surfaced article.

The proposed apparatus provides a flexible control of the electroslag process due to the independent adjustment of a number of parameters, e.g. the slag pool temperature and the amount of filler material to be fed. When necessary (at the start, at the end or after an accidental interruption of the process), a protracted heating of the slag pool and of the workpiece may be provided without feeding filler material, which eliminates the need to remove subsequently the bottom portion of the ingot or deposited layer, and prevents the occurrence of rejects caused by sedimentation of non-heated metal particles when the process is resumed after an interval.

An alternative embodiment of the current supply sleeve of the mould, having an electrically insulated liner, makes it possible to use the mould as a single-coil inductor which provides a rotary motion of the molten slag and of the metal entrained by said slag. Thus, mixing of the molten metal achieves a uniform distribution of heat along the perimeter of the sleeve, which in turn decreases the wear of the mould wall body due to elimination of visible microarcing on the slag-mould interface.

Moreover, the mixing raises the coefficient of heat transfer from the slag to the area being surfaced and to the filler material, which results in better efficiency of the process.

The application of a consumable electrode in combination with filler material to which current is not supplied also contributes to a higher efficiency of the process.

Parallel current supply to the top sleeve of the mould and to the consumable electrode positioned in the center of the reaction space of the mould provides a uniform distribution of current about the slag pool face and enables flattening out the shape of the solidified front as much as possible.

BRIEF DESCRIPTION OF THE DRAWINGS

Other objects and advantages of the present invention will become apparent from consideration of the following embodiments thereof in conjunction with the accompanying drawings. In the drawings.

DESCRIPTION OF THE PREFERRED EMBODIMENTS

Figure 1:
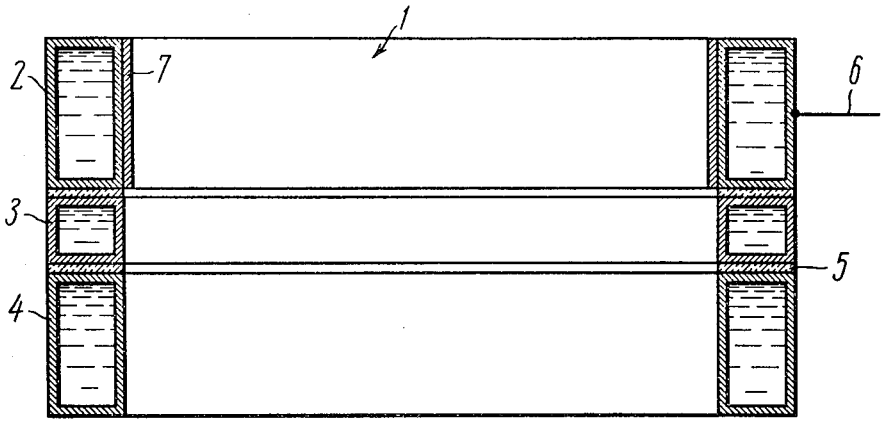
FIG. 1 a longitudinal sectional view of a mould for electroslag remelting and surfacing of metals according to the invention.
Figure 2:
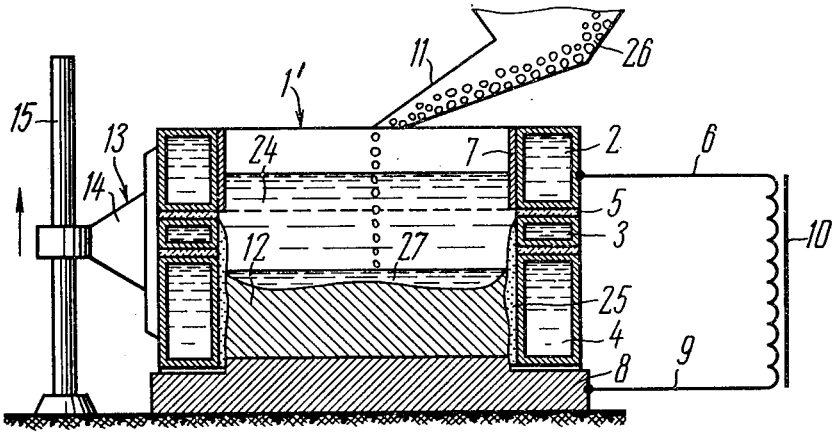
FIG. 2 is a typical cross-sectional view of an electroslag remelting and surfacing apparatus comprising the mould illustrated in FIG. 1.

Referring now to the drawings and to FIGS. 1 and 2 in particular, there is shown therein a mould 1 for electroslag remelting and surfacing of metals, which has an annular wall body forming an opened-end cavity and divided into superimposed sleeves 2, 3, 4 with a coolant being supplied to the inner and outer walls thereof (coolant supply conduit is not shown).

The cross-section of these sleeves 2, 3, 4 may be, in general, of any shape which is determined by the desired shape of the ingot to be made or by the article being surfaced.

Intermediate each pair of adjoining sleeves 2–3 and 3–4, there are placed insulating gaskets 5 made, for instance, of asbestos or mica.

The top sleeves 2 of the mould 1 has a lead 6 which connects said sleeve to a power source, to be described below. For the protection from spark erosion the sleeve 2 has a lining 7 made of electrically conducting material. If carbonization of metal is permissible, the lining is made of graphite. It is also possible to make the lining of a refractory metal, such as tungsten or molybdenum.

The bottom sleeve 4 is positioned on the base plate 8 (FIG. 2) which has a lead 9. The leads 6 and 9 are connected to a power source 10, which, as shown in the diagram, is a transformer. Thus connected to the power source 10, the base plate 8 and the top sleeve 2 of the mould 1 form a pair of non-consumable electrodes in the electroslag remelting and surfacing apparatus according to the present invention.

Above the melting space defined by the base plate 8 and the wall body of the mould 1, there is positioned a filler feed mechanism 11, more particularly described herein below.

To displace the slag pool as the ingot 12 grows in the process of electroslag remelting, the mould 1 is coupled with a lifting mechanism 13 which may be any conventional device, e.g., a driving carriage 14 movably mounted on a column 15. If the apparatus is designed for plane surfacing only, for instance, of a workpiece 16 in FIG. 3, then due to a relatively small thickness of the deposited layer, the mould is mounted stationary as there is no need to move it.

In case of ring-type surfacing of workpieces, e.g., of a roll 17 (FIG. 4) of a relatively long length, the mould 1, as in the case of remelting, is mounted on the lifting mechanism 13. In this case the base plate 8' of the apparatus has with an opening 18 for the neck of the roll 17, so that the surface of the base plate 8' supports the barrel being surfaced.

Figure 3:
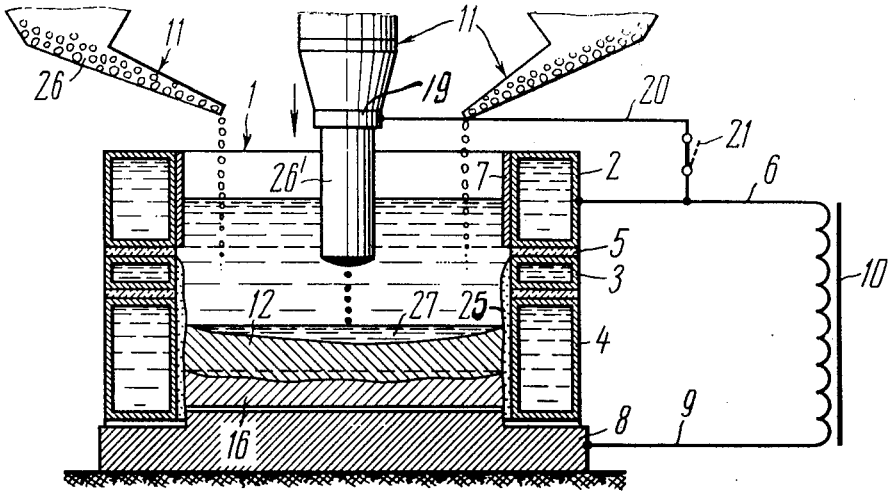
FIG. 3 is another cross-sectional view of an electroslag remelting and surfacing apparatus which is used for the flat surfacing of flat-shaped workpieces.
Figure 4:
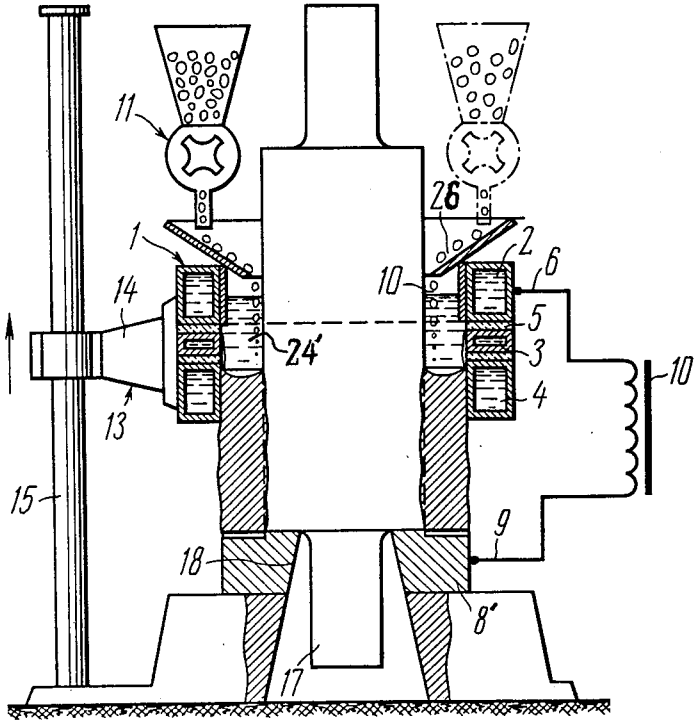
FIG. 4 is a cross-sectional view of an alternative embodiment of the electroslag remelting and surfacing apparatus which is used for the ring-type surfacing of cylinder-shaped workpieces, such as rolls for a rolling mill.

It should be noted that the elements designated by like reference numerals without indices in different figures are common for the embodiments of the invention shown therein, and though, for lack of space, feed mechanisms of various types are conventionally shown as filler feed mechanism 11 in FIGS. 2–4, it is to be understood that in every embodiment of the invention any known suitable means of said purpose may be used. The type and construction of this mechanism depend on the form of filler material. It may be a loose material feeder, as shown in FIGS. 2 and 4, a nozzle for wire or rod, or a mechanism for feeding bars, tubes and similar articles. A combined alternative embodiment is also possible, as shown in FIG. 3.

The filler feed mechanism 11, shown in FIGS. 2, and 3, is not supplied with current.

An alternative embodiment of the invention is possible, wherein in order to influence the solidified front shape, the filler feed mechanism 11 has a clamp 19 (FIG. 3) with a current lead 20 connected to the power source 10 in parallel with the current lead 6. The current lead 20 has a separate switch 21 for independent connection to the circuit of the power source 10.

Figure 5:
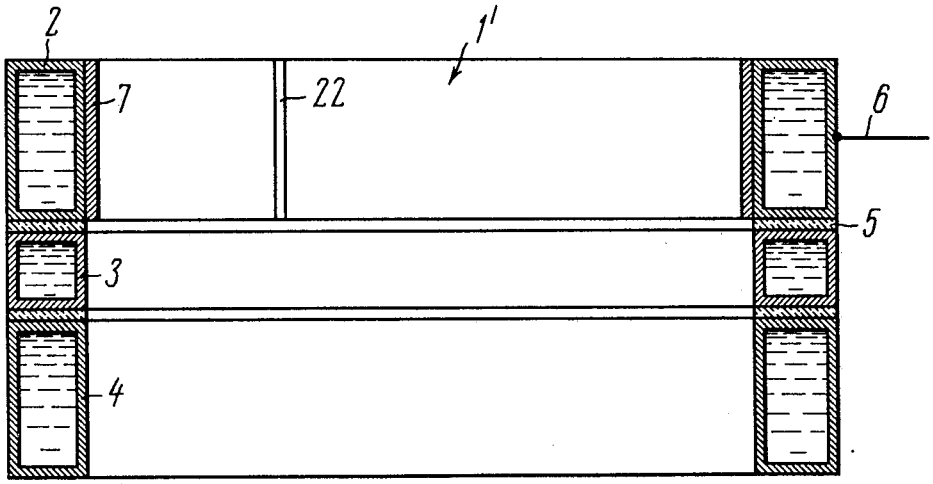
FIG. 5 is another longitudinal sectional view of an alternative embodiment of a mould for electroslag remelting and surfacing of metals.
Figure 6:
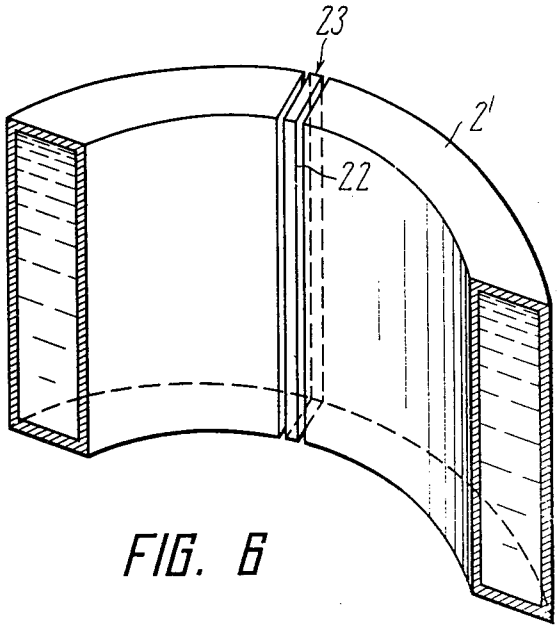
FIG. 6 is a fragmentary perspective view of a current supply sleeve of the mould shown in FIG. 5.

In an alternative embodiment of the mould 1' for electroslag remelting and surfacing, shown in FIG. 5, the wall of the current supply sleeve 2' is provided with a radially orientated vertically extending open slot 22 filled with an electrically insulating material, e.g., asbestos or mica (FIG. 6).

Figure 7:
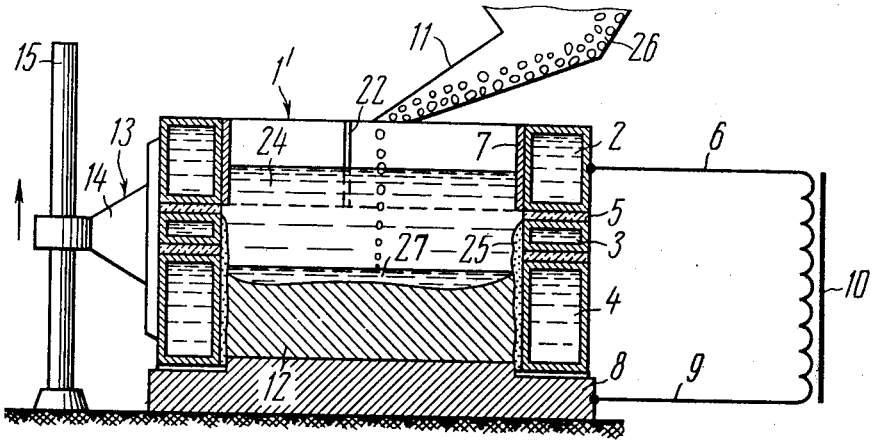
FIG. 7 is a cross-sectional view of an alternative embodiment of the electroslag remelting and surfacing apparatus comprising the mould illustrated in FIG. 5.

In the embodiment of the electroslag remelting and surfacing apparatus, shown in FIG. 7, the sleeve 2' of the mould 1', illustrated in FIG. 5, functions as a means for creating an electromagnetic field force which causes a unidirectional stable rotary motion of the molten slag. The constructional embodiment of the mould in accordance with FIG. 5 and the apparatus in accordance with FIG. 7 is preferred, though an embodiment of the electroslag remelting and surfacing apparatus is possible, wherein use is made of any other means for creating an electromagnetic field force causing a rotary motion, such as a conventional inductor positioned in concentric relationship with the mould (not shown). There is also possible an embodiment of the electroslag remelting and surfacing mould formed of a single sleeve having a slot filled with an electrically insulating material.

In this case a consumable electrode is connected to the power source of the apparatus wherein such mould may be used (not shown), and said single sleeve also functions as second electrode of the apparatus and means for creating electromagnetic field force causing a rotary motion.

The process of melting in the propsed apparatus, according to FIG. 2, begins with the formation of a slag pool 24. As soon as the liquid slag level reaches the sleeve 2 of the mould, the circuit of the power source 10 is closed, and welding current passes to the base plate 5 through the current lead 6, the sleeve 2 of the mould 1 and the slag pool 24.

Current does not flow through the sleeves 3 and 4 of the mould 1, as they are insulated from the top sleeve 2 by the gaskets 5 and from the slag pool 24 by a non-conducting slag crust 25 which is formed in the slag layers adjoining the mould 1 due to their rapid cooling.

As a result of heating of the slag pool 24, filler material 26 fed therein melts and flows to the base plate 8 forming a metal pool 27 which progressively rises as the filler material is melted.

Figure 8B:
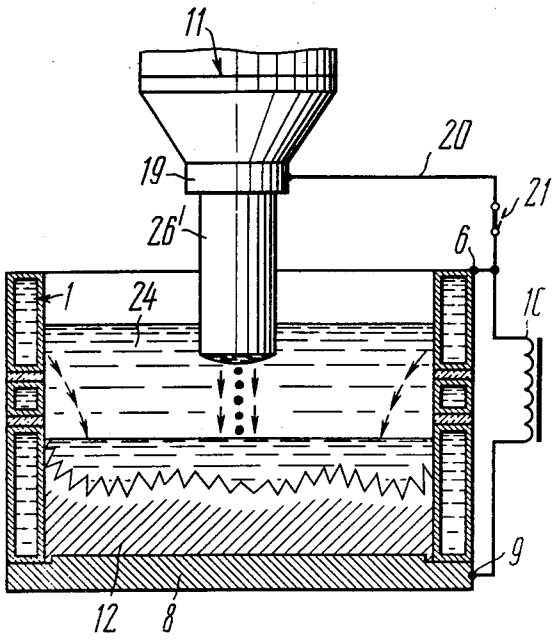
FIG. 8*a, b* are diagrams showing crystal growth in relation to current supply system of the apparatus.
Figure 8A:
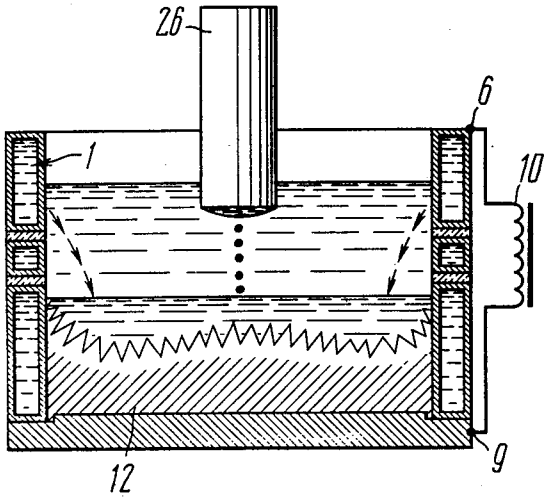

Peripheral heating of the metal pool 27 caused by passing current through the sleeve 2 of the mould 1 conditions the convex shape of the solidified front in the center of the pool 27 (FIG. 8*a*). When it is necessary to obtain a more favorable nearly flat solidified front (FIG. 8*b*), current is passed, in parallel with the sleeve 2 of the mould 1, through filler material 26[1] which is fed into the center of the pool 24 (FIG. 3), thereby converting the former into a consumable electrode. In this case, use is made of the filler feed mechanism 11 comprising the clamp 19 with the current lead 20. It is to be understood that the filler material is fed fully or partially in a compact form, such as wire, rod, etc. A combined feeding of filler material in the form of a consumable electrode and of metal to which current is not applied improves the efficiency of the electroslag process.

Parallel connection of the clamp 19 of the filler feed mechanism 11 to the power source 10 provides a possibility of independent control of the current lead 20. Thus, in all embodiments, the mechanism 11 controlling the filler material 26' does not fed same before the temperature of the slag pool 24 reaches a predetermined value. This eliminates the dangerous condition of defective areas forming in the ingot due to insufficient heating of metal at the start or after an accidental interruption of the electroslag process.

The graphite or refractory metal lining 7 on the interior surface of the sleeve 2 of the mould 1 prevents damage to the mould by microarcing on the slag-mould interface.

When the level of the metal pool 27 (FIG. 2) approaches the middle sleeve 3, the lifting mechanism 13 moves the mould 1 upwards providing for a possibility of a further growth of the ingot 12.

Basically, instead of the mould 1 the base plate 8 may be moved in the opposite direction. In this case the mould 1 is secured stationary, while the base plate 8 is mounted on a suitable travel mechanism (not shown).

The process of surfacing of a flat workpiece 16 (FIG. 3) and of a cylindrical or similar shaped workpiece 17 (FIG. 4) does not differ, in the main, from the electroslag melting process set forth herinabove.

The workpiece 16 (FIG. 3) is placed on the base plate 8. To save the rate of metal consumption, it is desirable that the mould size should conform to that of the area being surfaced. After the slag pool 24 is formed and the workpiece 16 is heated till the surface thereof partially melts into the slag pool 24, filler material 26 and/or 26' is fed which is melted by the slag and uniformly distributed about the whole surface of the workpiece.

For ring-type surfacing the roll 17 of a rolling mill (FIG. 4) is vertically positioned in the center of the apparatus on the base plate 8' so that the barrel thereof rests on the surface of the base plate 8'. A ring-shaped slag pool 24' is formed. As the roll 17 is heated, filler material 26 is fed into the slag pool 8', preferably in the form of segments or small grains. For uniform distribution of the material relative to the area being surfaced it is desirable to move the filler feed mechanism 11 about the roll 17, as shown in FIG. 4 by the dot-dash lines illustrating the mechanism in a shifted position. As the surfacing proceeds, the mould 1 is lifted by means of the mechanism 13 to maintain a constant level of the slag pool 24'.

In the electroslag remelting and surfacing apparatus of FIG. 7 which comprises the mould 1', (shown in FIG. 5) which apparatus may be modified similar to the embodiments thereof shown in FIGS. 3 and 4, it should be noted that the electroslag process disclosed hereinabove is accompanied by a rotary motion of the slag pool 24.

Figure 9A:
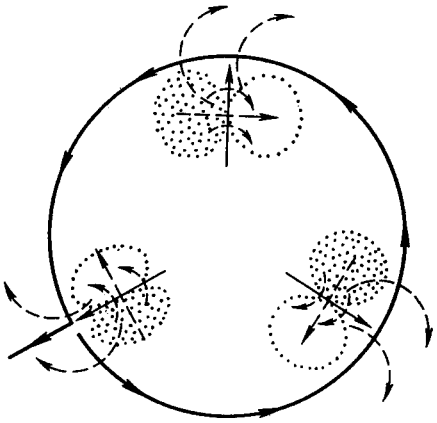
FIG. 9*a, b* diagrammatically illustrates the arrangement of electric and magnetic force lines in the slag pool of the apparatus of the invention.
Figure 9B:
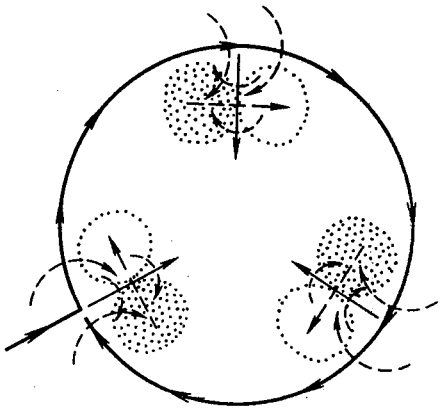

It should also be noted that when current passes through the sleeve 2 of the apparatus comprising the mould 1 (FIGS. 2–4), local displacements or instantaneous rotations may occur in the slag pool, but these movements are of chaotic character, beyond calculation or control, and do not provide uniform distribution of heat in the pool and uniformity of the metal structure in the product. In the mould 1' the slot 22, electrically disconnecting the sleeve 2' by means of electrically insulating material 23, stabilizes the passage of current through the entire periphery of said sleeve 2' which functions as a single-coil inductor connected in series to the welding circuit (the direction of current flow is shown by solid circles with arrows. Versions a and b in FIG. 9 correspond to different semi-periods of alternating current). Force lines of the magnetic field surrounding the section 2' (shown in FIGS. 9*a* and 9*b*) as dotted arrows interact with the magnetic fields of different force lines of welding current inside the slag pool 24 (FIG. 7), which is actually an ionic conductor. These force lines are shown by radially orientated solid line arrows. In the apparatus for ring-type surfacing of workpieces, similar to that shown in FIG. 4 but comprising the mould 1', the actual direction of said force lines is approximately coincident with that shown in FIG. 9*a*. In other embodiments of the apparatus described hereinabove the direction of these force lines is nearly vertical.

The direction of the magnetic force lines which arise in the slag pool 24 (FIG. 7) around the force lines of current (also shown by dotted lines in FIG. 9) coincide on one side of said force lines of current with the direction of the magnetic force lines surrounding the section 2'. Whereas on the other side this direction is opposite. As a result of interaction of these magnetic force lines, within the slag pool 24 there are formed alternate zones of different magnetic field intensity (in FIGS. 9*a* and 9*b*) the zones of increased intensity are shown by hatching). Due to the effect of balancing the intensity, there arise magnetodynamic forces which cause the slag pool 24 to rotate (FIG. 7). By comparing the diagrams 9*a* and 9*b*, one can see that the direction of the rotary motion is independent from the direction of welding current flow. Thus, when alternating current is supplied, there takes place a unidirectional stable rotary motion of the slag pool. The speed of rotation depends on the intensity of current being passed, on physical and chemical properties of the slag and on the size of the mould.

The rotary motion of the slag pool caused by magnetodynamic forces is imparted to the metal pool 27 (FIG. 7) as a result of friction between the slag and molten metal.

The rotary motion stipulates uniform distribution of heat throughout the slag pool 24 and molten metal, thereby preventing microarcing on the interface between the slag and the walls of the mould 1', which microarcing causes an increased and non-uniform wear of said wall body.

Moreover, mixing of the slag intensifies the process of refining metal from various adverse impurities and inclusions (such as phosphorus, sulphur, etc.) as well as brings about a considerable increase (30% and more) of the melting rate factor of the source material, thereby improving the efficiency of the electroslag process.

The mould 1', which combines the functions of a mould proper, of a non-consumable electrode and of an inductor, makes it possible to improve the electroslag process without making the construction of the electroslag remelting and surfacing apparatus more complicated.

The proposed electroslag remelting and surfacing apparatus generates metal of an improved structure in ingots or in a deposited layer, and by simple constructional means and techniques it enables the production of metal having any predetermined properties.

Being readily adaptable for carrying out the electroslag process in a manner similar to that effected by apparatus with non-consumable electrodes, the proposed apparatus combines the advantages inherent in the aforedescribed prior-art apparatus with constructional simplicity characteristic of apparatus with consumable electrodes.

It should be emphasized tht the designation of parts and reference numerals given in the disclosure and in the drawings are merely illustrative with respect to the described embodiments and are by no means limiting the scope of the invention.

Since only a limited number of embodiments of our invention have been set forth in the disclosure, it is to be understood that changes may be made in the construction of the parts described and shown in the drawings within the scope of the following claims without departing from the invention.

We claim:

1. In an electrode remelting and surfacing apparatus, a base plate connected to a power source and serving as a non-consumable electrode, a hollow water-cooled mould disposed to top said base for forming an ingot, said mould having an annular cross-sectional wall body forming an opened-end cavity and comprising at least three water cooled superimposed sleeves electrically insulated from one another with the middle sleeve or sleeves being of a height substantially smaller than that of the other sleeves, a top sleeve of said sleeves being electrically connected to said power source to serve as another non-consumable permanent electrode in the electroslag process and the top sleeve having a refractory and electrically conductive lining; said mould or said base plate being movable as said ingot is grown in said mould, whereby effective utilization of the entire slag pool area is achieved and said sleeve eliminating the need for a conventional consumable electrode.

2. In an electroslag remelting and surfacing apparatus, a base plate connected to a power source and serving as a non-consumable electrode, a hollow water-cooled mould disposed atop said base for forming an ingot, said mould having an annular cross-sectional wall body forming an opened-end cavity and comprising at least three water cooled superimposed sleeves of generally uniform diameters electrically insulated from one another with the middle sleeve or sleeves being of a height substantially smaller than that of the other sleeves, a top sleeve of said sleeves being electrically connected to said power source to serve as another nonconsumable permanent electrode in the electroslag process and the top sleeve having a refractory and electrically conductive lining; said mould or said base plate being movable as said ingot is grown in said mould, whereby effective utilization of the entire pool area is achieved and said sleeve eliminating the need for a conventional consumable electrode.

3. An apparatus according to claim 2, including a filler feed mechanism, for dispensing filler material into said mould, connectible in parallel with the top sleeve of the mould and to said power source so that said filler material functions as a consumable electrode.

4. The apparatus according to claim 2 or 1, wherein said lining is made of graphite.

* * * * *